US005657898A

United States Patent [19]

Portman et al.

[11] Patent Number: 5,657,898

[45] Date of Patent: Aug. 19, 1997

[54] CUP LID HAVING INFUSION BAG RETAINING MEANS

[76] Inventors: Jill Portman; Gary Shinner, both of 132 Marion Ave., Mill Valley, Calif. 94941

[21] Appl. No.: 529,061

[22] Filed: Sep. 15, 1995

[51] Int. Cl.[6] ..... A47G 19/22

[52] U.S. Cl. ..... 220/712; 215/387; 220/254; 220/711; 220/713; 426/77; 426/80; 426/83

[58] Field of Search ..... 220/254, 711, 220/712, 713; 426/83, 80, 77, 435; 215/387

[56] References Cited

U.S. PATENT DOCUMENTS

| | | | |
|---|---|---|---|
| D. 282,615 | 2/1986 | Levine . | |
| 2,728,671 | 8/1955 | Young et al. . | |
| 3,459,324 | 8/1969 | Miller . | |
| 3,797,642 | 3/1974 | Dobry et al. . | |
| 3,861,284 | 1/1975 | Costello | 426/80 X |
| 4,141,462 | 2/1979 | Rucci | 220/713 X |
| 4,333,583 | 6/1982 | Montemarano | 220/712 |
| 4,503,992 | 3/1985 | Sitko et al. | 220/713 |
| 4,629,088 | 12/1986 | Durgin | 220/713 X |
| 5,183,172 | 2/1993 | Boller | 220/712 X |
| 5,197,624 | 3/1993 | Dodaro | 220/712 X |
| 5,253,781 | 10/1993 | Van Melle et al. . | |

*Primary Examiner*—Allan N. Shoap
*Assistant Examiner*—Robin A Hylton

[57] ABSTRACT

A container cover having chamber for retaining a porous filter bag, such as a tea bag. The cover has an upwardly extending protrusion forming the retaining chamber. The protrusion has an aperture enabling passage of the drawstring of the tea bag. An opening closed by a removable lift tab is formed in the container cover for access to liquid contents of the container. The protrusion and opening are located opposite one another on the container cover. The user withdraws the tea bag from the liquid contents of the container into the retaining chamber by pulling the drawstring of the tea bag through the aperture. The aperture resiliently grasps the drawstring. The container cover and porous filter bag are used and discarded without causing direct handling of the porous filter bag.

6 Claims, 2 Drawing Sheets

CUP LID HAVING INFUSION BAG RETAINING MEANS

BACKGROUND OF THE INVENTION

1. Field of the Invention

The present invention relates to disposable cup lids. More specifically, it relates to a disposable cup lid with a recess which is especially suited for the retraction and storage of a teabag after its use within the cup. The present invention also relates to lids or caps which could be used to diffuse a chemical or the like into a sealed container while preventing outside contamination during the process. The present invention could be applied in the fast food industry, chemical industry, paint industry, medical industry, and for applied uses in outer space.

2. Description of the Prior Art

U.S. Pat. No. 3,459,324, issued to W. L. Miller on Jan. 11, 1968, shows a vented lid for a drinking cup consisting of two disks for the absorption of vapors released from the cup contents. In contrast, the device of the instant invention is a disposable cup lid which has a protrusion in the lid surface for the retraction of a teabag after its immersion in the contents of the cup without requiring the removal of the lid itself.

U.S. Pat. No. 5,398,843, issued to Warden et al. on Mar. 21, 1995, shows a molded plastic lid for attachment to a disposable cup which allows consumption of the contents of the cup without removing the lid. In contrast, the device of the instant invention shows an attachable lid with a protrusion on the upper surface and a semi-perforated tab which may be lifted to expose a section of the cup rim so the contents may be consumed without removing the lid.

U.S. Pat. No. 2,728,671, issued to J. Young et al. on Aug. 26, 1954, shows an attachable lid for a cup with a porous container incorporated for diffusion into the cup contents. In contrast, the device of the instant invention is able to have the porous filter removed from the contents of the cup without removing the lid.

U.S. Pat. No. 5,253,781, issued to Van Melle et al. on Oct. 19, 1993, shows a disposable drink cup lid with a protrusion consisting of a hole for the consumption of the contents of the cup. In contrast, the device of the instant invention shows a cup lid with a protrusion containing a slot or other opening for the insertion of a teabag string or the like and having a separate area of the lid for the consumption of the cup contents.

U.S. Pat. No. 3,797,642, issued to Dobry et al. on Mar. 19, 1974, shows a device for holding a porous filter such as a teabag in a dissolving liquid so that it can quickly be removed from said liquid. In contrast, the instant invention is a device in which the porous filter may be retracted from the liquid without removing the container cover.

U.S. Pat. No. Des. 282,615, issued to Levine on Feb. 18, 1986, shows a cup with a side pocket for the placement of a teabag. In contrast, the instant invention enables retention of a tea bag or the like within the cup or receptacle, and not externally to the cup or receptacle.

None of the above inventions and patents, taken either singly or in combination, is seen to describe the instant invention as claimed.

As will be seen, the simplicity and effectiveness of my invention is not rivaled in the prior art.

SUMMARY OF THE INVENTION

Briefly, the invention comprises a lid for a container which has a primarily rectangular protrusion on the upper lid surface which is used to facilitate the retraction and support of a porous filter which has been used to dissolve a liquid in the container to which the lid is attached. The lid also has an opening enabling consumption of the container contents without interfering with the retraction and support of the aforementioned porous filter or storage thereof.

Accordingly, it is a principal object of the invention to provide a new and improved container lid device which overcomes the disadvantages of the prior art in a simple but effective manner.

It is a major object of this invention to provide a container cover from which a porous filter bag is suspended in a liquid in which the porous filter bag may be removed from the liquid without removing the entire container cover.

It is another object of the invention to provide a container cover that will receive a porous filter bag with string attachment without modification to the container.

It is another object of the invention to provide a container cover which removes excess liquids from a porous filter bag upon removal from the liquid in which it was, immersed by pulling it into a recess of the container cover that has less volume than the porous filter bag.

It is another object of the invention to provide a container cover that holds a porous filter bag thus handling of the porous filter is not necessary since it is discarded with the lid.

It is another object of the invention to provide a container cover that provides a means for controllably mixing a dry chemical with a liquid in a sealed container without exposing either to the external environment.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
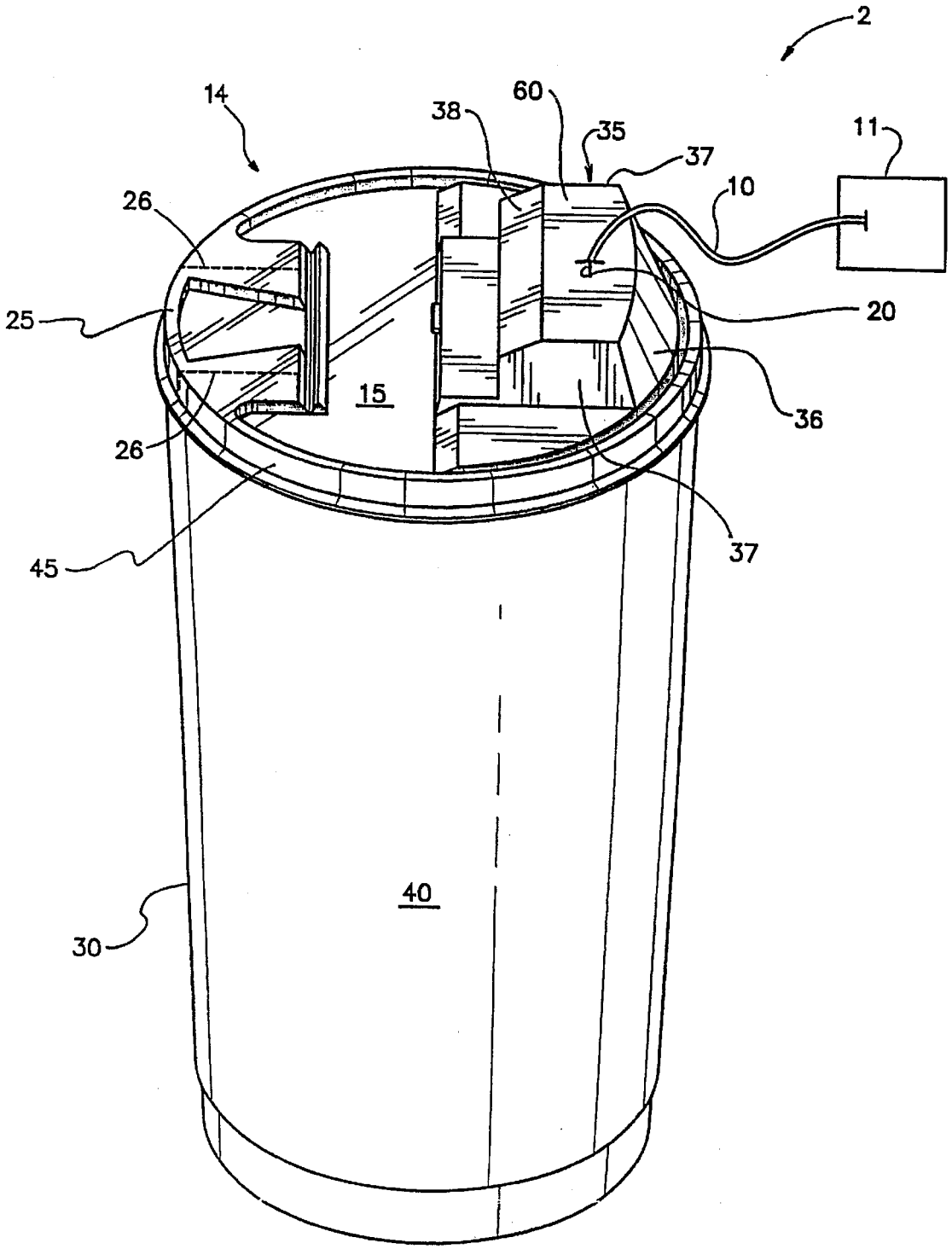
FIG. 1 is an environmental perspective view of the invention.
Figure 2:
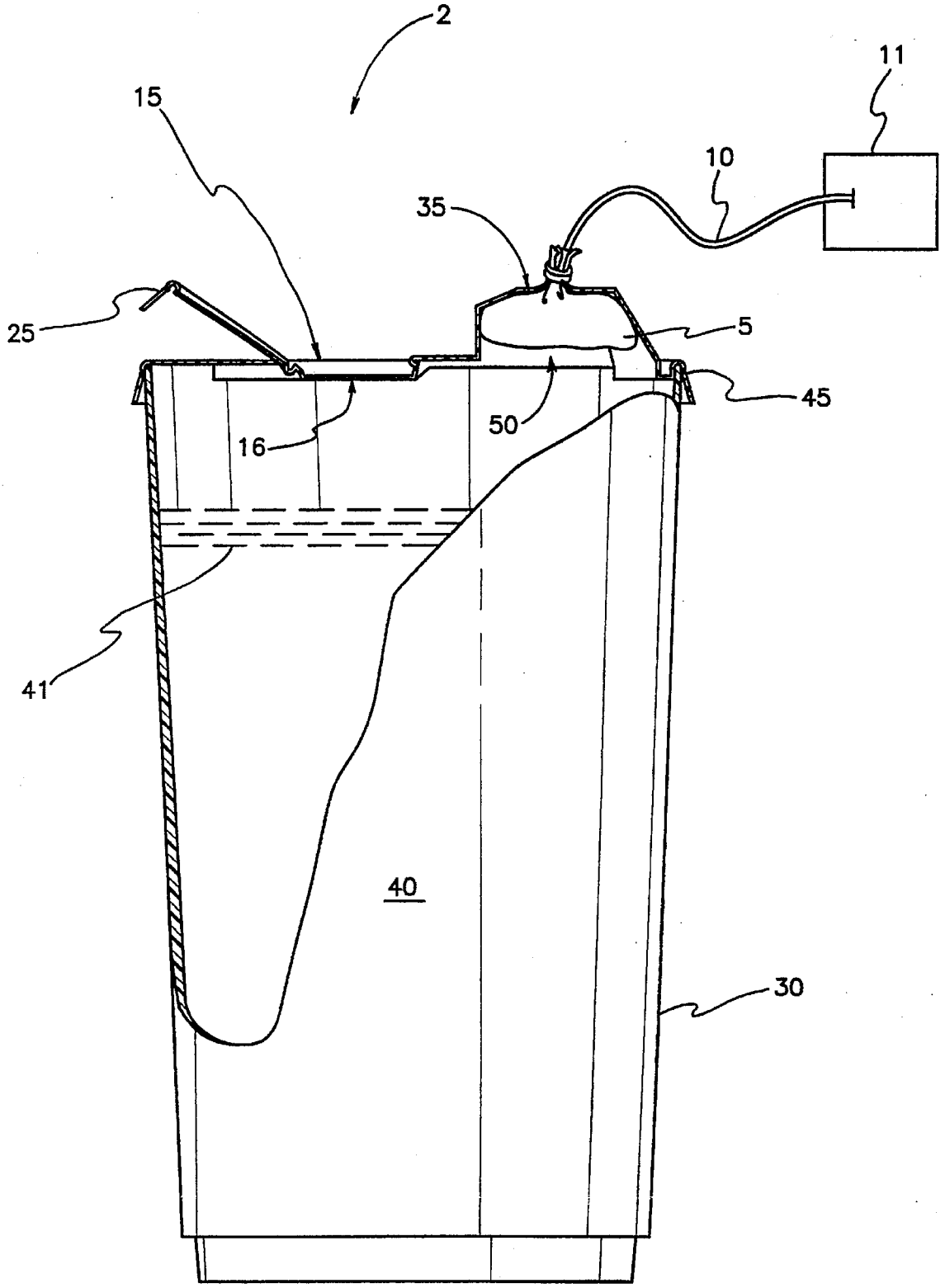
FIG. 2 is a side view, partially broken away, of the invention.

Turning now to FIG. 1 of the drawings, the novel container cover 2 has a central panel 14 bearing an upper surface 15, a lower surface 16, a upwardly extending protrusion 35, a lift tab 25, and a container engagement means 45. Upwardly extending protrusion 35 has a front panel 38, a rear panel 36, two lateral panels 37, and a flexible top panel 60. Top panel 60 has intersecting incisions forming an aperture 20 for accommodating insertion of a string 10 of a filter or infusion bag 5. Aperture 20 resiliently grips string 10, preventing string 10 from moving freely when gripped. Protrusion 35 projects above surface 15, as seen in FIGS. 1 and 2. Porous filter bag string 10 conventionally has a tab 11 attached to the upper end.

Container cover 2 includes engagement means 45 for attachment over and continuously contacting the vertically extending wall 30 of container 40. Porous filter bag 5 is removed from the liquid container contents 41 (see FIG. 2) in container 40 by pulling up on porous filter bag string attachment 10 or tab 11, thus pulling porous filter bag 5 into recess area 50 of upwardly extending protrusion 35. Recess 50 is created below the lower surface 16 of cover 2 and within upwardly extending protrusion 35. Recess area 50 is of a smaller volume than soaked porous filter bag 5. Thus, pulling the porous filter bag 5 into recess 50 with the porous filter bag string attachment 10 causes a squeezing effect forcing excess liquid out of porous filter bag 5 and into the interior of container 40. The porous filter bag 5 is not easily extricated through aperture 20 due to the small size of the aperture means relative to the porous filter bag 5.

Upwardly extending protrusion 35 is located on cover 2 near an edge of cover 2. Protrusion 35 and lift tab 25 are both offset from or located away from the center of cover 2. As depicted, protrusion 35 is located on cover 2 diametrically opposite lift tab 25. Upwardly extending protrusion 35 could also be frustoconical, semi-spherical, semi-tubular, as would be obvious.

The container cover 2 is held to the container on the sidewall of the container 40 by engagement means 45. The engagement means 45 formed around the periphery of container cover 2 has a lesser diameter of that of the sidewalls of container 40, thereby establishing a seal between container 40 and the container cover 2 to prevent spillage of the container contents 41.

Lift tab 25 comprises two spaced semi-perforated lines 26 which extend from the peripheral outer edge of container cover 2 inwardly towards the center of container cover 2, far enough for the tab 25 to be lifted to expose an interior section of container 40 allowing the user to drink the contents without violating the integrity of the upwardly extending protrusion 35. The lift tab 25 is opened by manually lifting up on the portion of the container cover 2 between the two semi-perforated lines 26 on the container cover periphery. It is contemplated that for fabrication purposes, this is the most suitable location. The lift tab 25 does not extend to the upwardly extending protrusion 35, thus not violating the integrity of the upwardly extended protrusion 35.

Container cover 2 is preferably fabricated from a thin, resilient sheet of material, such as plastic, having a thickness and a predetermined strength. The predetermined strengths resists upward and downward distension of container cover 2 and the upwardly extended protrusion 35.

In use, the user would place the porous filter bag string tab 11 through the upwardly extending protrusion aperture 20. Container cover 2 is placed onto container 40, porous filter bag is immersed in container contents 41 and, porous filter bag 5 is left in container contents 41 for a desired length of time. Porous filter bag 5 is removed from container contents 41 by pulling porous filter bag string tab 11 or porous filter bag string 10 until porous filter bag 5 is pulled into recess 50. The user would then be able to drink the liquid in container 40 using the exposed area of the container revealed by lift tab 25. The container cover 2, and porous filter bag 5 are discarded without causing direct handling of porous filter bag 5.

It is to be understood that the provided illustrative examples are by no means exhaustive of the many possible uses for my invention.

From the foregoing description, one skilled in the art can easily ascertain the essential characteristics of this invention, and without departing from the spirit and scope thereof, can make various changes and modifications of the invention to adapt it to various usages and conditions. For example, the artisan could easily adapt the container cover to dispense hazardous materials in a sealed container.

It is to be understood that the present invention is not limited to the sole embodiment described above, but encompasses any and all embodiments within the scope of the following claims:

We claim:

1. A cover for a container having a closed bottom with a vertically extending side wall extending from the bottom and terminating at an upper rim circumscribing an upper opening of the container, said cover enabling retention of an infusion bag utilized within the container, said cover comprising:

a central panel;

engagement means around an outer circumference of said panel for engaging the side wall of the container, said engagement means contacting the side wall of the container continuously about the circumference of the side wall proximate the rim;

a protrusion extending upwardly from said central panel, said protrusion having a recess for receiving the infusion bag anal an aperture for passing a draw string of the infusion bag through said cover; and drinking means disposed on said central panel for allowing passage of liquid from the interior of the container when said cover is engaged on the rim of the container, said protrusion and said drinking means being located apart from one another so as to allow a user to drink liquid through said central panel without interference from said protrusion while said infusion bag is retained in said protrusion, wherein said protrusion and said drinking means are offset from the center of said central panel and opposite one another on said central panel with respect to said center of said central panel.

2. The cover according to claim 1, said protrusion being fabricated from a resilient material, and said aperture of said protrusion comprising intersecting incisions, whereby said aperture is opened by drawing the infusion bag partially through said aperture with the draw string and the infusion bag being retained in said protrusion by said incisions upon release of the draw string.

3. A cover for a container having a vertically extending side wall, said cover enabling retention of an infusion bag utilized within the container, said cover comprising:

a central panel having an upper surface, a center and a circumference;

engagement means for engaging the side wall of the container, said engagement means contacting the side wall of the container continuously about the circumference of the side wall, said engagement means disposed about the circumference of said central panel;

a protrusion extending upwardly from said central panel, said protrusion having a recess for receiving the infusion bag and an aperture for passing a draw string of the infusion bag through said cover; and a removable closure disposed on said central panel for providing access to the interior of the container when said cover is placed on and closes the container, said protrusion and said removable closure being located offset from said center of said central panel and opposite one another on said central panel with respect to said center of said central panel.

4. The cover according to claim 3, said protrusion being fabricated from a resilient material, and said aperture of said protrusion comprising intersecting incisions, whereby said aperture is opened by drawing the infusion bag through said aperture.

5. The cover according to claim 3, having semi-perforated lines formed in said central panel, thereby forming said removable closure.

6. A cover for a container having a vertically extending side wall, said cover enabling retention of an infusion bag utilized within the container, said cover being fabricated from a resilient material and comprising:

a central panel having an upper surface, a center and a circumference;

engagement means for engaging the side wall of the container, said engagement means contacting the side wall of the container continuously about the circumference of the side wall, said engagement means disposed about the circumference of said central panel;

a protrusion extending upwardly from said central panel, said protrusion having a recess for receiving the infusion bag and an aperture for passing a draw string of the infusion bag through said cover; and a removable closure disposed on said central panel for providing access to the interior of the container when said cover is placed on and closes the container, said cover having semi-perforated lines formed in said central panel, thereby forming said removable closure in said central panel, said protrusion and said removable closure being located offset from said center of said central panel and opposite one another on said central panel with respect to said center of said central panel.

* * * * *

UNITED STATES PATENT AND TRADEMARK OFFICE

CERTIFICATE OF CORRECTION

PATENT NO. : 5,657,898

DATED : August 19, 1997

INVENTOR(S) : Jill Portman et al.

It is certified that error appears in the above-indentified patent and that said Letters Patent is hereby corrected as shown below:

On the title page, item [56], references cited:
Delete "8/1969"and insert --8/1968--.

In column 3, line 47, delete "strengths" and insert --strength--.

In column 4, line 25, delete " bag anal an" and insert --bag and an--.

Signed and Sealed this

Twenty-fifth Day of November, 1997

*Attest:*

*Attesting Officer*

Bruce Lehman

BRUCE LEHMAN

*Commissioner of Patents and Trademarks*